US005182181A

United States Patent [19]

Koizumi et al.

[11] Patent Number: 5,182,181

[45] Date of Patent: Jan. 26, 1993

[54] RESIN COATED CARRIERS FOR ELECTROSTATIC IMAGE DEVELOPMENT AND THE METHOD OF PREPARING THE SAME

[75] Inventors: Yoshiaki Koizumi; Kenji Tsujita; Shigenori Kouno; Ken Ohmura, all of Hachioji, Japan

[73] Assignee: Konica Corporation, Tokyo, Japan

[21] Appl. No.: 670,304

[22] Filed: Mar. 15, 1991

[30] Foreign Application Priority Data

Mar. 20, 1990 [JP] Japan ..... 2-68202

[51] Int. Cl.[5] ..... G03G 9/113

[52] U.S. Cl. ..... 430/108; 430/111; 430/137; 427/216; 427/221; 428/407

[58] Field of Search ..... 430/108, 111, 137; 427/216, 221; 428/407

[56] References Cited

U.S. PATENT DOCUMENTS 4,209,550 6/1980 Hagenbach et al. ..... 427/27

FOREIGN PATENT DOCUMENTS 20181 12/1980 European Pat. Off. .
22347 1/1981 European Pat. Off. .
228174 9/1988 Japan ..... 430/137
235958 9/1988 Japan ..... 430/137
229267 9/1989 Japan ..... 430/108
87167 3/1990 Japan ..... 430/108

OTHER PUBLICATIONS

Patent Abstracts of Japan, vol. 12, No. 245 (P-729)(3092); Jul. 12, 1988 JPA-63-37358; Feb. 18, 1988.

Patent Abstracts of Japan, vol. 13, No. 37 (P-819)(3385) Jan. 27, 1989 JPA-63-235959; Sep. 30, 1988.

*Primary Examiner*—Roland Martin
*Attorney, Agent, or Firm*—Jordan B. Bierman

[57] ABSTRACT

The invention relates to a carrier and method of making a carrier in which elementary resin particles of volume average particle size not more than 0.5 m are fused on their surfaces to form secondary particles of BET surface areas of 5 to 150 m/g and volume average particle size of 1.5 to 5.0 m, which secondary particles are coated by a dry method on core particles to form carrier particles.

10 Claims, No Drawings

RESIN COATED CARRIERS FOR ELECTROSTATIC IMAGE DEVELOPMENT AND THE METHOD OF PREPARING THE SAME

FIELD OF THE INVENTION

The present invention relates to resin coated carriers for electrostatic image development that are employed in electrophotography, electrostatic recording or electrostatic printing and a method of preparing the same, more specifically, to resin particles for coating the surfaces of carrier core particles by the dry method and a method of preparing the same.

BACKGROUND OF THE INVENTION

A two-component developer used in electrophotography is generally a mixture of toners and carriers. Carriers are used to give toners an appropriate amount of electrostatic charge of suitable polarity.

Resin-coated carriers that are prepared by coating the surfaces of carrier core particles with a resin is advantageously employed due to its improved durability and frictional chargeability.

The spray-coating method, an example of a wet method, has been widely employed to provide a resin coating layer oh the surface of a core particle. However, by this method, resin particles are likely to agglomerate, resulting in difficulty in obtaining carriers with a prescribed size distribution in a high yield. This method also has such a defect as a prolonged production time.

The following are the methods other than the spray coating that have been proposed to solve the above problems:

1. Coating by the dry method the surface of a core particle with resin particles of which the particle sizes are not more than 1/10 of the core particle (disclosed in Japanese Patent Application Open to Public Inspection No. 235959/1988).
2. Coating by the dry method the surface of a core particle with resin particles at a temperature higher than the melting point of the resin particles (disclosed in Japanese Patent Application Open to Public Inspection No. 35735/1979).
3. Heating metal core particles with specific surface areas of 200 to 1300 $cm^2/g$ at 160° to 343.3° C. for 20 to 120 minutes using 0.05 to 3.0% by weight of elementary particles with particle sizes of 0.1 to 30 μm (disclosed in Japanese Patent Application Open to Public Inspection No. 118047/1980).
4. Coating by the dry method the surface of a core particle with resin particles with an average particle size of not more than 1 μm (disclosed in Japanese Patent Application Open to Public Inspection No. 27858/1988).
5. Forming a layer of polymeric fine particles on the surface of a core particle, and solidifying it (disclosed in Japanese Patent Application Open to Public Inspection No. 37360/1988).

In the preceding methods 2, 3, 4 and 5 where resin particles being in contact with the surface of a core particle are melted forcibly, they are likely not only to stick to each other but also to help core particles stick to each other, thus making it difficult to obtain resin-coated carriers with a prescribed size distribution in a high yield. These methods also have problems that a prolonged cooling time is needed since a resin layer is formed at high temperatures, and that the surface of a resin coating layer becomes uneven, since part of a resin film tends to peel off when agglomerated core particles are crushed to increase the yield. The unevenness of a resin coating layer makes the frictional chargeability of a carrier unstable at high temperature and humidity.

By the method 1, it is hard to obtain a carrier with a uniform resin coating layer, since the spreadability and film-forming property of resin particles are poor due to their large particle sizes.

Another dry method was proposed. In the method a magnetic particle is coated with a resinous substance which comprises adding to magnetic particles with a weight average particle size of 10 to 200 μm resin particles of which the weight average particle size is not more than 1/200 of that of the magnetic particles to form a uniform mixture, and giving impact to this mixture repeatedly in a mixer of which the temperature is set in the range of 50° to 110° C. (Japanese Patent Application Open to Public Inspection No. 87168/1990).

However, this method has been found to have a problem that the handling of resin particles is difficult due to their extremely small sizes. For instance, resin particles are likely to fly during the production process, making sufficient mixing difficult. Further, when coating is performed by the dry method in a mixer having a rotator, where air purge is usually done to protect the sealed portion of a bearing, resin coating efficiency, i.e. the weight ratio of resin particles that are formed into a layer to those as raw material, decreases due to serious fly loss of resin particles.

Due to such low resin coating efficiency, considerable amounts of resin particles or agglomerated resin particles are allowed to remain on the surface of a carrier in a free state without forming a film (these particles and agglomerated particles will often be referred to as "white powder"). Such white powder tends to stick to the surface of a resin-coated carrier electrostatically, and hinder the frictional charging of carriers and toners, making toners charged only weakly. This phenomenon causes fogging at the early stage of forming an image.

When a large amount of white powder is present on the surface of a resin-coated carrier, it tends to transfer to a light-sensitive element selectively at the time of developing, affecting adversely developing and cleaning conditions. That is, since white powder has a charging polarity opposite to that of a toner, it selectively sticks to the non-image-forming portion of a light-sensitive element, and is sent to the cleaning portion without being transferred. This leads to the overloading of the cleaning portion, and then to insufficient cleaning. If cleaning is insufficient, the surface of a light-sensitive element is subjected to filming. As a result of this, the light-sensitivity of a light-sensitive element is lowered, causing an image to be fogged.

SUMMARY OF THE INVENTION

One object of the invention is to provide resin coated carrier, particles having a sturdy resin coating layer with a uniform thickness.

Another object of the invention is to provide resin coated carrier particles, which are formed with a minimum amount of white powder sticking thereto.

Still another object of the invention is to provide a method of preparing the preceding resin coated carrier particles effectively.

Further object of the invention will be disclosed in the description.

The carrier of the invention comprising a resin coated carrier particle comprises a core particle and a resin coated on the surface thereof, whose resin is coated by a dry method with secondary resin particles composed of elementary resin particles with a volume average particle size of not more than 0.5 μm that are fused together on their respective surfaces wherein the secondary resin particles have BET specific surface areas of 5 to 150 $m^2/g$; and a volume average particle size of 1.5 to 5.0 μm.

These secondary resin particles can be prepared by a method which comprises introducing a dispersion of elementary resin particles having a volume average particle size of not more than 0.5 μm as measured upon the completion of polymerization into an airborne dryer to remove the liquid phase, thereby allowing said elementary resin particles to be fused together on their respective surfaces to form porous secondary resin particles which has a volume average particle size of 1.5 to 5.0 μm and BET specific surface areas of 5 to 150 $m^2/g$. The BET value is preferably 10 to 120 and more preferably 20 to 100 $m^2/g$.

The carrier is prepared by mixing the resin coated carrier particle with additives, for example lubricant and so on, if necessary.

The resin particles used for coating the core particles are not small-sized elementary resin particles but porous secondary particles with larger sizes that are formed by the fusion of a plurality of elementary particles. These particles, due to their BET specific surface areas and volume average particle size set in specific ranges, have improved spreadability to carrier core particles, and can be mixed with core particles sufficiently without causing fly loss. Therefore, by using the resin particles of the invention, it is possible to prepare effectively a resin coating layer with a sufficient strength and a uniform thickness. In addition, by the effective formation of a resin coating layer, the amount of white powder sticking to a resin-coated carrier is minimized, thus improving the frictional chargeability of a resin-coated carrier.

According to the method of the invention where a dispersion of elementary resin particles is introduced into an airborne dryer to remove the liquid phase, thus allowing said particles to be fused together on their respective surfaces to form a secondary resin particle, the elementary resin particles are fused together while being dispersed adequately by the air current, and, therefore, are prevented from excessive agglomeration. As a result, it is possible to produce secondary resin particles with BET specific areas and a volume average particle size being in prescribed ranges.

In conventional methods, elementary resin particles are likely to agglomerate excessively at the time of distilling the liquid phase, and, hence, it is impossible to obtain the porous secondary resin particles of the invention.

DETAILED DESCRIPTION OF THE INVENTION

BET specific surface area is measured with, for example, a micromeritics flow sorb (Type II2300; manufactured by Shimazu Corporation).

Volume average particle size is measured by means of, for example, a laser diffraction type size distribution measuring machine (HEROS; sold by Japan Electronics Corporation). Dispersion of secondary resin particles is performed over a period of two minutes by means of a ultrasonic homogenizer with an output power of 150 W after resin particles, a surfactant and water (disperse system) are put in a beaker of 50 cc capacity.

The BET specific surface areas of the secondary resin particles are satisfactory when it is in the range of 5 to 150 $m^2/g$. Since impacting power to be applied on the secondary resin particles during dry coating depends on the particle sizes of core particles, larger BET specific surface areas of the secondary particles are preferable when the sizes of core particles are small. If the BET specific surface areas of the secondary resin particles are large, sufficient spreadability to core particles can be obtained with minimum impacting power, and as a result, a film of excellent property can be obtained. Meanwhile, a simple, elementary resin particle with a particle size of about 2 μm has a BET specific surface area of smaller than 5 $m^2/g$.

If the BET specific surface area of a secondary resin particle is smaller than 5 $m^2/g$, its spreadability to the surface of a core carrier particle is poor, making it difficult to obtain a coating layer of uniform thickness. In this case, secondary resin particles tend to agglomerate to form white powder, and such white powder may stick to the surface of a resin-coated carrier electrostatically, causing insufficient development. In addition, since a considerable amount of secondary resin particles are present in a free state without forming a layer on the surface of a core particle, there may be a substantial lowering of resin coating efficiency.

In the case of a BET specific surface area exceeding 150 $m^2/g$, it is difficult to handle secondary resin particles because of their extremely small particle sizes, and as a result, fly loss of resin particles may occur, causing resin coating efficiency to be lowered. Such lowering of resin coating efficiency is observed most frequently when coating is performed by the dry method with a rotary mixer equipped with air purge function.

When the volume average particle size of secondary resin particles is smaller than 1.5 μm, though spreadability is improved due to large BET specific surface areas, handling of resin particles is difficult because of their small particle sizes, and as a result, fly loss of resin particles tends to occur, resulting in a lowered resin coating efficiency.

When secondary resin particles have a volume average particle size exceeding 5.0 μm, their spreadability to a core particle is lowered due to excessive agglomeration of elementary resin particles. In this case, as secondary resin particles have smaller BET specific surface areas, their film-forming property is so poor as will cause themselves to agglomerate to form white powder. The presence of such white powder hinders successful development.

Elementary resin particles which constitute the secondary resin particle of the invention are small resin particles with particle sizes of not more than 0.5 μm. By using such small-sized elementary resin particles, it is possible to obtain without fail secondary resin particles with BET specific surface areas and a volume average particle size as stated above.

When the sizes of elementary resin particles exceed 0.5 μm, the spreadability of secondary resin particles is lowered due to their extremely small BET specific surface areas. Here, elementary resin particles are defined as particles which are present separately without agglomerating.

Resins for elementary resin particles are not limitative. In the invention, since the application of secondary resin particles is performed by the dry process, resins hardly soluble in solvents are also usable. Therefore, there is a wide choice in the kind of usable resin. The examples of usable resin include a styrene-based resin, an acryl-based resin, a styrene-acryl-based resin, a vinyl-based resin, an ethylene-based resin, a rosin-modified resin, a polyamide resin, a polyester resin, a silicone resin, a fluorine-based resin and mixtures thereof.

Of them, a styrene-acryl-based resin and an acryl-based resin are preferable. A styrene-acryl-based resin is obtained by the copolymerization of a styrene-based monomer and an acryl-based monomer.

The specific examples of a styrene-based monomer include styrene, o-methylstyrene, m-methylstyrene, p-methylstyrene, α-methylstyrene, p-ethylstyrene, 2,4-dimethylstyrene, p-butylstyrene, p-t-butylstyrene, p-hexylstyrene, p-octylstyrene, p-nonylstyrene, p-decylstyrene, p-dodecylstyrene, p-methoxystyrene, p-phenylstyrene, p-chlorostyrene, 3,4-dichlorostyrene and mixtures thereof.

The specific examples of an acryl-based monomer include acrylic acid and its esters such as acrylic acid, methyl acrylate, ethyl acrylate, butyl acrylate, isobutyl acrylate, propyl acrylate, octyl acrylate, dodecyl acrylate, lauryl acrylate, 2-ethylhexyl acrylate, stearyl acrylate, 2-chloroethyl acrylate, phenyl acrylate and methyl α-chloroacrylate; methacrylic acid and its esters such as methacrylic acid, methyl methacrylate, ethyl methacrylate, propyl methacrylate, butyl methacrylate, isobutyl methacrylate, octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; and mixtures thereof.

In preparing a styrene-acryl-based resin, the weight ratio of a styrene-based monomer to an acryl-based monomer is preferably 9:1 to 1:9. A styrene component makes a resin coating layer harder, and an acryl component makes it sturdier. By adjusting the weight ratio of a styrene component and an acryl component adequately, it is possible to control the charging amount of toner to a considerable level in frictional charging of a carrier and a toner.

The method of the present invention will be described below.

The dispersion of elementary resin particles are prepared by, for example, emulsion polymerization of suspension polymerization.

In the invention, a dispersion of elementary resin particles having a volume average particle size of not more than 0.5 μm as measured upon the completion of polymerization is introduced into an airborne dryer to remove the liquid phase, thereby allowing said elementary resin particles to be fused together on their respective surfaces to form porous secondary resin particles which have a volume average particle size of 1.5 to 5.0 μm and BET specific surface areas of 5 to 150 $m^2/g$.

An airborne dryer of spray dryer type is preferable in the invention. This type of dryer can allow elementary resin particles to be fused together and dried, while preventing them from excessive agglomeration by suitably dispersing them. As a result, it is possible to produce effectively secondary resin particles having BET specific surface areas and a volume average particle size falling within the preceding ranges.

For a higher yield of secondary resin particles, it is preferred that the removal of the liquid phase by an airborne dryer be followed by a pulverizing process. By the addition of this process, it is possible to obtain secondary resin particles having the above-specified volume average particle size even if elementary resin particles agglomerate excessively. Meanwhile, if the volume average particle size of secondary resin particles is too large, spreadability to a core particle is impaired, and, as a result, it is difficult to obtain a resin coating layer with a uniform thickness, even though the BET specific surface areas of secondary resin particles are large enough.

For pulverizing, a jet mill is preferably employed. By using a jet mill, fusion of secondary resin particles can be effectively prevented, and, as result, secondary resin particles with a volume average particle size falling within the prescribed range can be produced efficiently. On the other hand, when pulverizers commonly used such as a hammer mill are used, fusion of secondary resin particles tends to occur at the time of pulverization, since the heat capacities of secondary resin particles are small due to their small particle sizes.

The secondary resin particles of the invention are employed for coating the surface of a carrier core particle by the dry method. In this process no solvent or liquid midium for carrying the secondary particles are utilized. Magnetic particles are preferable as such core particles. In respect of frictional chargeability with a toner as well as adhesion of a carrier to a light-sensitive element, it is preferred that such magnetic particles have a weight average particle size of 10 to 200 μm. The measurement of the volume average particle size is performed by Microtrack Type 7981-OX (manufactured by Leeds and North Rup).

Substances usable as the magnetic particles include those which are strongly magnetized by a magnetic field in its direction such as iron, cobalt and nickel, and alloys and compounds of these metals.

"Ferrite" is a general term for iron-containing magnetic oxides, and means ferrite represented by $MO \cdot Fe_2O_3$, wherein M represents a divalent metal such as nickel, copper, zinc, manganese, magnesium and lithium.

Using the secondary resin particles of the invention, a resin-coated carrier can be prepared by the following method:

Hundred (100) parts by weight of core particles and 0.1 to 10 parts by weight, preferably 0.5 to 4 parts by weight, of secondary resin particles are mixed uniformly by means of a normal stirrer. To this mixture, impact is repeatedly given over a period of 10 to 60 minutes, preferably 15 to 30 minutes, by means of a high-speed stirring mixer of which the temperature is set at 50° to 110° C. By this dry process, the secondary resin particles are allowed to stuck to and spread on the surface of the magnetic core particle, forming a resin coating layer thereon.

The intensity of impact to be applied to the mixture of secondary resin particles and core particles is not limitative, as long as it is not too much to crush magnetic particles. The film-forming property of secondary resin particles is improved by increasing impact power within such a range as will not cause magnetic particles to be crushed.

EXAMPLES

The present invention will be described in more detail according to the following working and comparative examples. In the following examples, "parts" means "parts by weight".

EXAMPLE 1

An aqueous dispersion of elementary resin particles consisting of particles of a copolymer (weight ratio: 8:2) of methyl methacrylate and butyl methacrylate having a solid content of 20% was introduced into a sprayer dryer (manufactured by Ohgawara seisakusyko), with a feeding rate of 7 liter per hour and dried to remove the liquid phase. The temperature of the dryer was 130 °±10° C. at the inlet and 42°±5° C. at the outlet portion. The dried particles were then pulverized by means of a jet mill (current Jet; manufactured by Nisshin Engineering), to obtain porous secondary resin particles with a volume average particle size of 3.0 μm and a BET specific surface area of 39 $m^2/g$.

EXAMPLE 2

Porous secondary resin particles with a volume average particle size of 1.6 μm and a BET specific surface area of 150 $m^2/g$ were prepared in substantially the same manner as in Example 1, except that the dispersion was replaced with one that has a solid content of 16%, and particles of a copolymer (weight ratio: 7:3) of methyl methacrylate and butyl acrylate having a volume average particle size of 0.02 μm as measured upon the completion of polymerization were used as the elementary resin particles and that the drying conditions were changed to 125 °±10° C. at the inlet and 38 °±5° C. at the outlet. The feeding rate was 6 l/h.

EXAMPLE 3

Porous secondary resin particles with a volume average particle size of 4.9 μm and a BET specific surface area of 5 $m^2/g$ were prepared in substantially the same manner as in Example 1, except that the dispersion was replaced with one having solid content of 25% and particles of a copolymer (weight ratio: 8:2) of methyl methacrylate and butyl methacrylate having a volume average particle size of 0.20 μm as measured upon the completion of polymerization were used as the elementary resin particles and that the drying conditions were changed to 130 °±10° C. at the inlet and 43 °±5° C. at the outlet and the feeding rate was 8 l/h.

EXAMPLE 4

Porous secondary resin particles with a volume average particle size of 2.9 μm and a BET specific surface area of 35 $m^2/g$ were prepared in substantially the same manner as in Example 1, except that the dispersion was replaced with one having solid content of 20% and particles of a copolymer (weight ratio: 6/4) of methyl methacrylate and styrene) having a volume average particle size of 0.08 μm as measured upon the completion of polymerization were used as the elementary resin particles and the drying conditions were changed to 180 °±10° C. at the inlet and 57 °±5° C. at the outlet and the feeding rate was 7 l/h.

COMPARATIVE EXAMPLE 1

Secondary resin particles having a volume average particle size of 3.8 μm and a BET specific surface area of 4.5 $m^2/g$ were prepared in substantially the same manner as in Example 1, except that the feeding amount of the elementary resin particles supplied was increased to 10 l/h and that the air current temperature was elevated to 180 °±10° C. at the inlet and 57 °±5° C. at the outlet.

COMPARATIVE EXAMPLE 2

Secondary resin particles having a volume average particle size of 5.1 μm and a BET specific surface area of 25 $m^2/g$ were prepared in substantially the same manner as in Example 1, except that the drying conditions were changed.

COMPARATIVE EXAMPLE 3

Secondary resin particles having a volume average particle size of 1.4 μm and a BET specific surface areas of 50 $m^2/g$ were prepared in substantially the same manner as in Example 1, except that the solid content of the dispersion was changed to 15% and the drying conditions were changed to 170 °±10° C. at the inlet and 57 °±5° C. at the outlet, and the feeding rate was 6l/h.

COMPARATIVE EXAMPLE 4

Secondary resin particles having a volume average particle size of 11.3 μm and a BET specific surface area of 3 $m^2/g$ were prepared in substantially the same manner as in Example 1, except that the airborne dryer was replaced by a normal vacuum dryer.

COMPARATIVE EXAMPLE 5

Secondary resin particles having a volume average particle size of 14.8 μm and a BET specific surface area of 1 $m^2/g$ were prepared in substantially the same manner as in Example 1, except that the airborne dryer was replaced by a normal indirect heating vacuum dryer. These secondary resin particles contain a considerable amount of large particles with particle sizes exceeding 25 μm.

EVALUATION

100 Parts of each of the resin particles obtained in the above working and comparative examples and 4900 parts of core particles consisting of Cu-Zn ferrite particles (volume average particle size: 80 μm) were stirred over a period of 15 minutes by means of a high-speed stirring mixer. Then, the temperature of this mixer was elevated to 70° C. by circulating hot water. At this temperature, stirring was continued for another 20 minutes, while giving impact power to the mixture by the rotation of the mixer's main stirring blade, thus performing dry coating of core carrier particles with the resin.

For each resin-coated carrier, the amount of resin applied, resin coating efficiency and the transmittance of white powder were evaluated. The results are shown in Table 1. The measuring methods are as follows:

(1) AMOUNT OF RESIN APPLIED

The amount of resin applied is defined by the following formula:

$$\text{Amount of resin applied (wt \%)} \frac{\text{Weight of applied resin}}{\text{Weight of carrier}} \times 100$$

The measurement of the weights of resin applied and carrier was performed as follows:

1. The tare weight of a glass-made sample tube of 30 cc capacity was measured accurately by means of a chemical balance. This weight was designated as Weight A.
2. About 3 g of a resin-coated carrier was put in a tared sample tube of 30 cc capacity, and weighed accurately by means of a chemical balance. This weight was designated as Weight B.

3. About 20 cc of methyl ethyl ketone was put in the above sample tube. The tube was covered, and stirred for 10 minutes by a wave rotor (Model WR-60; manufactured by Thermonics Corp.), thereby allowing the resin to be molten.
4. The procedures 3 were repeated five times to remove the resin completely. The tube was then put in an oven heated to 60° C. for drying, then cooled to room temperature. The weight after the removal of the resin was measured. This weight was designated as Weight C.

From Weights A, B and C, the weight of resin applied and the weight of carrier were calculated by the following equations:

Weight of resin applied = Weight B − Weight C

*Weight of carrier = Weight B − Weight A*

(2) RESIN COATING EFFICIENCY

Resin coating efficiency is defined by the following formula:

$$\text{Resin coating efficiency } \frac{\text{Amount of resin applied}}{\text{Theoretical amount of resin applied}} \times 100$$

If there is no loss of applied resin, resin coating efficiency becomes 100%. The amount of applied resin in the above formula is the value obtained by the method (1), and includes the amount of white powder (explained later).

(3) TRANSMITTANCE OF WHITE POWDER

The measurement of white powder transmittance is aimed at examining the amount of resin particles or agglomerates thereof that fail to form a film and electrostatically stick to and remain on the surface of a carrier particle in a free state. The higher the white powder transmittance, the smaller the amount of white powder. No practical difficulty arises with a white powder transmittance of not less than 90%.

The white powder transmittance was measured by a process comprising introducing 20 g of each carrier and 15 ml of methanol into 20 ml-sample tube, stirring by a wave rotor at 46 rpm, and putting the supernatant into a cell for an electrimetric colorimeter (wavelength: 522 nm) to examine the transmittance of white powder.

TABLE 1

| | Amount of resin applied | Resin coating efficiency | White powder transmittance |
|---|---|---|---|
| Example 1 | 1.92 | 96.0 | 98 |
| Example 2 | 1.89 | 94.5 | 99 |
| Example 3 | 1.93 | 96.5 | 96 |
| Example 4 | 1.88 | 94.0 | 98 |
| Comparative Example 1 | 1.90 | 95.0 | 89 |
| Comparative Example 2 | 1.93 | 96.5 | 86 |
| Comparative Example 3 | 1.64 | 82.0 | 98 |
| Comparative Example 4 | 1.76 | 88.0 | 65 |
| Comparative Example 5 | 1.65 | 82.5 | 57 |

As is evident from the results, high resin coating efficiency and white powder transmittance could be obtained when coating of a carrier was performed by the dry process with the secondary resin particles of the present invention.

In Comparative Examples 1 and 2, the white powder transmittance were lower than those of Examples 1 to 4, due to the too small BET specific surface areas (Comparative Example 1) and too large volume average particle size (Comparative Example 2) of the secondary resin particles.

The resin coating efficiency in Comparative Example 3 was lower than those of Examples 1 to 4 since the volume average particle size of the secondary resin particles was too small.

In Comparative Examples 4 and 5, both the resin coating efficiency and white powder transmittance were lower than those of Examples 1 to 4, since the volume average particle size and BET specific surface areas of the secondary resin particles were too small.

What is claimed is:

1. A carrier for electrostatic image development comprising a resin coated carrier particle which comprises a core particle and a resin coated on the surface thereof, whose resin is coated by a dry method with secondary particles composed of elementary resin particles with a volume average particle size of not more than 0.5 μm that are fused on their surface, wherein the secondary particles have BET specific surface areas of 5 to 150 $m^2/g$; and a volume average particle size of 1.5 to 5.0 μm.

2. The carrier according to claim 1, wherein the BET specific surface areas is 10 to 120 $m^2/g$.

3. The carrier according to claim 2, wherein the BET specific surface areas is 20 to 100 $m^2/g$.

4. The carrier according to claim 1, wherein the resin is a styrene resin, an acryl resin, styrene-acryl resin, a vinyl resin, an ethylene resin, a resin-modified resin a polyamide resin, a polyester resin, a fluorine resin or mixture thereof.

5. The carrier according to claim 4, wherein the resin is a styrene-acryl resin and an acryl resin.

6. The carrier according to claim 1, wherein the elementary resin particles are prepared by emulsion polymerization or suspension polymerization.

7. A method of preparation of a resin coated carrier particle comprising fusing on their surface elementary resin particles with a volume average particle size of not more than 0.5 μm to form secondary particles having BET specific surface area of 5 to 150 $m^2/g$ and a volume average particle size of 1.5 to 5.0 μm coating said secondary particles on a surface of core particles by a dry method.

8. The method according to claim 7, wherein the BET specific surface areas is 10 to 120 $m^2/g$.

9. The method according to claim 8, wherein the BET specific surface areas is 20 to 100 $m^2/g$.

10. The method according to claim 7, wherein the elementary resin particles are prepared by emulsion polymerization or suspension polymerization.

* * * * *